US006129513A

United States Patent [19]

Halliwell et al.

[11] Patent Number: 6,129,513

[45] Date of Patent: Oct. 10, 2000

[54] FLUID SEAL

[75] Inventors: Mark A Halliwell; Alec G Dodd, both of Derby, United Kingdom

[73] Assignee: Rolls-Royce plc, London, United Kingdom

[21] Appl. No.: 09/294,136

[22] Filed: Apr. 20, 1999

[30] Foreign Application Priority Data

Apr. 23, 1998 [GB] United Kingdom ..... 9808656

[51] Int. Cl.[7] ..... F01D 11/08

[52] U.S. Cl. ..... 415/173.4; 415/173.5; 415/173.6

[58] Field of Search ..... 415/173.4, 173.5, 415/173.6, 138, 209.2, 209.3, 209.4

[56] References Cited

U.S. PATENT DOCUMENTS

| | | | |
|---|---|---|---|
| 4,459,082 | 7/1984 | Niggemann . | |
| 4,662,821 | 5/1987 | Kervistin et al. . | |
| 4,863,345 | 9/1989 | Thompson et al. | 415/174.1 |
| 5,064,343 | 11/1991 | Mills | 415/173.3 |
| 5,145,316 | 9/1992 | Birch | 415/173.1 |
| 5,399,066 | 3/1995 | Ritchie et al. | 415/115 |

FOREIGN PATENT DOCUMENTS

| | | |
|---|---|---|
| 1 248 198 | 9/1971 | United Kingdom . |
| 1 308 963 | 3/1973 | United Kingdom . |

*Primary Examiner*—Edward K. Look
*Assistant Examiner*—Ninh Nguyen
*Attorney, Agent, or Firm*—Pillsbury Madison & Sutro LLP

[57] ABSTRACT

A fluid seal comprises a plurality of seal segments (24) which form a peripheral ring at the tip of turbine rotor blades (20). The upstream end (25) of each seal segment (24) is mounted on the static structure (27). The downstream end (26) of each seal segment (24) is supported by an inner flange (34) on a vane (32). The vane (32) is also provided with a radially outer flange (36) which locates in a radially inclined slot (31) in the casing (30). During engine transients, the vane (32) expands axially forward relative to the casing (30). The outer flange (36) rides up the inclined slot (31) which causes the seal segment (24) to move radially outward and increases the seal clearance. However, during stabilized engine running, the relative axial movement between the casing (30) and the vane (32) is reduced. The outer flange (36) contracts down the inclined slot (31) to move the seal segment (24) radially inwards; the combination reduces the tip clearance and prevents excessive gas leakage.

10 Claims, 2 Drawing Sheets

FLUID SEAL

The present invention relates to a fluid seal and in particular to a fluid seal for use between components capable of relative rotational movement.

The turbine section of a gas turbine engine consists of several stages each employing one row of stationary nozzle guide vanes and one row of rotating blades. A gap exists between the tips of the turbine blades and the casing which varies in size due to differential expansion and contraction. To reduce the loss of efficiency through gas leakage across the blade tips small static seal segments are used at the tip of each blade and are mounted from the casing structure to form a peripheral sealing ring around the blade tips.

The seal segments define a flow annulus through the turbine and reduce gas leakage from the annulus. To further reduce the gas leakage the clearance between the seal segments and the blade tips is preferably set to a minimum during stabilised engine running. However during transient conditions, such as engine acceleration, differential radial growth occurs and the clearance is further reduced. Radial incursions between the blades and the seal segments results in abrasion of the seal segments which increases the seal clearance and the leakage through the seal when the engine returns to stabilised running conditions.

The present invention seeks to provide an improved fluid seal for use in a rotor of a gas turbine engine in which radial incursions are reduced or avoided during transients so that the optimum minimum seal clearance is maintained during stabilised engine running.

According to the present invention a fluid seal comprises a plurality of seal segments, each end of the seal segments being located by support structure, the support structure at least one end of the seal segment is provided with means for translating axial movement of the support structure into radial movement of the seal segment.

The advantage of a fluid seal in accordance with the present invention is that radial movement of the seal segments prevents or reduces radial incursions between the seal segments and a series of blades which rotate in the flow annulus, when differential radial expansion and contraction occurs between the rotor blades and the seal segments.

Preferably the means for translating axial movement of the support structure into radial movement of the seal segments is an aperture or face which extends axially and is inclined radially. The inclined aperture or face may be provided either in the support structure or on the seal segment.

In the preferred embodiment of the present invention the seal segments define a flow annulus enclosing a rotating component. The rotating component may be a rotor in a gas turbine engine.

The support structure may be a vane supported by static structure such as a casing. The vane may have a flange which locates in an inclined aperture. Axial movement of the flange along the inclined aperture being translated into radial movement of the seal segment attached thereto. The seal segment may be attached to the vane by a further flange on the vane.

A fluid manifold may be provided to selectively heat or cool the support structure to control the amount of axial and radial movement.

The present invention will now be described with reference to the accompanying drawings in which.

Figure 1:
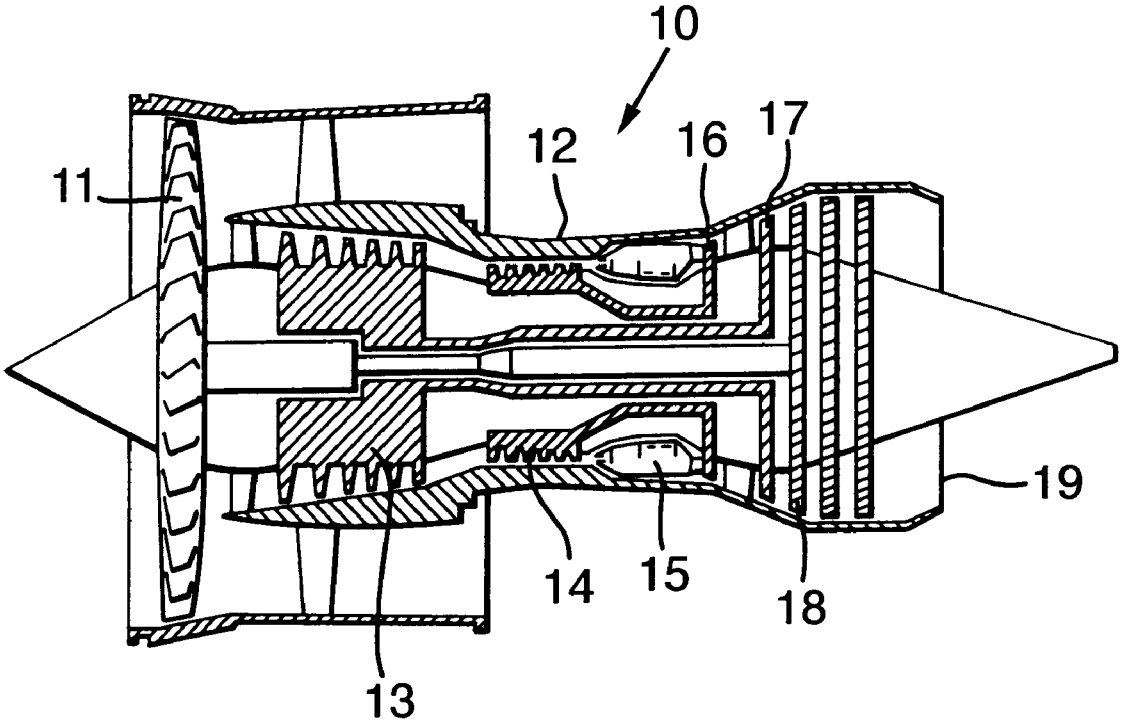
FIG. 1 is a diagrammatic sketch of a gas turbine engine incorporating a fluid seal in accordance with the present invention.

In FIG. 1 a ducted fan gas turbine engine generally indicated at 10 comprises a core engine within a casing 12. A fan 11 is driven by the core engine which comprises in flow series compressor sections 13 & 14, combustor 15 and turbine sections 16, 17 and 18 respectively.

The gas turbine engine 10 operates in conventional manner whereby air is drawn in and compressed by the fan 11 and compressor sections 13 and 14. The compressed air is then mixed with fuel and combusted in the combustor 15. The combusted mixture then expands through the turbine sections 16, 17 & 18 which are connected to the fan 11 and the compressor sections 13 and 14 to provide drive. Propulsive thrust is provided by the exhaust flow through an exhaust nozzle 19 and air from the fan 11 which bypasses the compressor sections 13 & 14.

Figure 2:
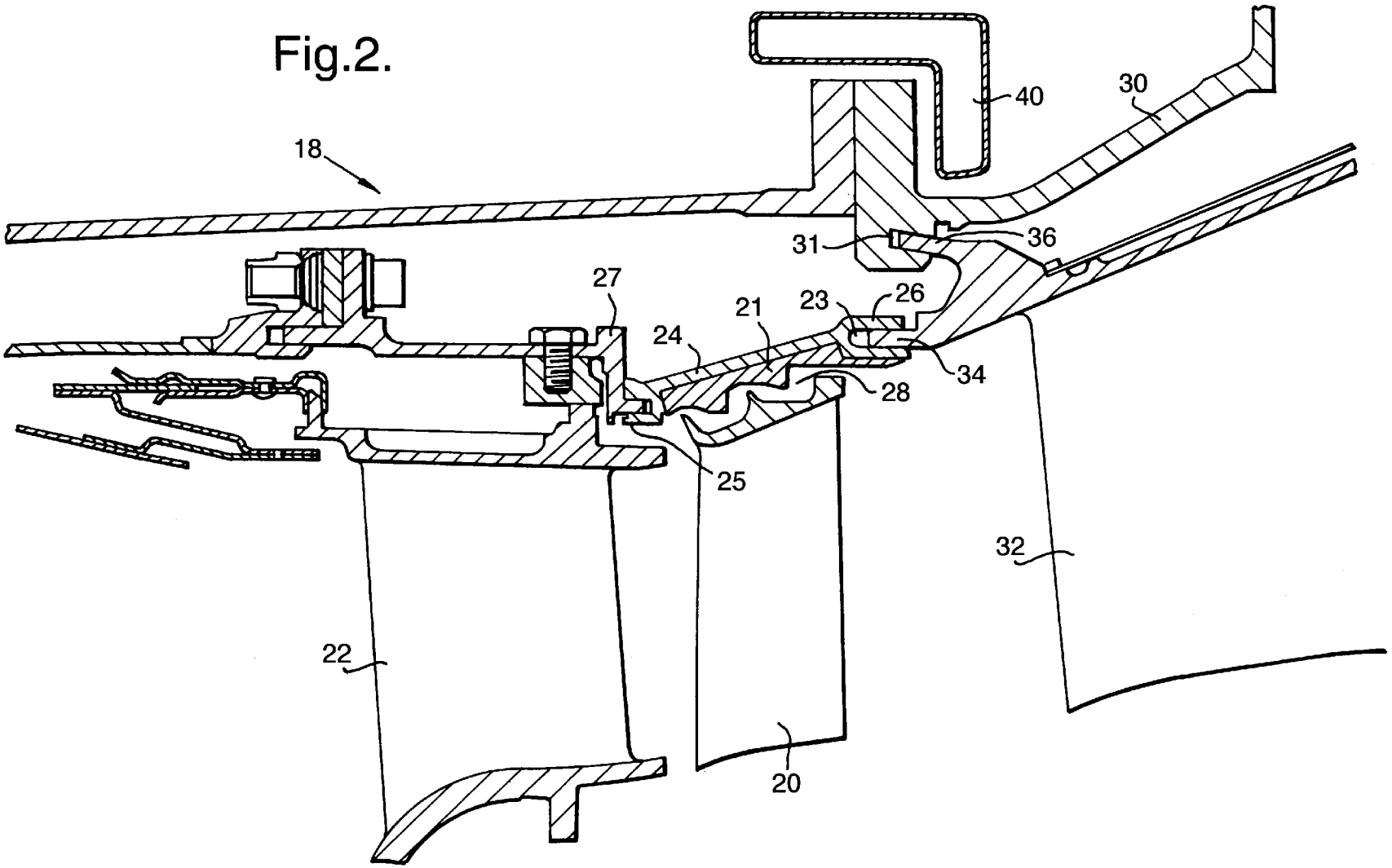
FIG. 2 is a sectional view of part of the turbine section of the gas turbine engine shown in FIG. 1.

Referring to FIG. 2 the high pressure turbine section 18 includes alternate rows of rotating turbine blades 20 and static vanes 22 & 32.

A plurality of seal segments 24 form a peripheral ring at the tip of each blade 20. The seal segments 24 define a gas flow annulus 28 through the turbine 18 and reduce gas leakage from the annulus 28.

In the preferred embodiment of the present invention an abradable honeycomb layer 21 is provided on the radially inner surface of each seal segment 24. The honeycomb layer 21 is abraded in the event of radial incursions between the rotor blades 20 and the seal segments 24. Damage to the seal segments 24 is thus avoided. Alternatively a non-abradable surface may be used and contact avoided by building into the engine appropriate radial clearances.

The upstream end 25 of each seal segment 24 is mounted on static structure 27 which supports adjacent vane 22.

The downstream end 26 of each seal segment 24 is supported from a nozzle guide vane 32. The nozzle guide vane 32 has a radially inner flange 34 and a radially outer flange 36. The inner flange 34 locates in a corresponding slot 23 on the seal segment 24, the outer flange 36 locates in a corresponding slot 31 in the casing 30. The slot 31 in the casing 30 extends axially and is inclined radially.

It will be appreciated by one skilled in the art that an inclined contact face may be used as an alternative to the inclined slot 31. The operation of this feature is uncompromised by the use of a single inclined contact face.

The other end of the nozzle guide vane 32 is axially located however the location means are not shown in FIG. 2.

During an engine acceleration the nozzle guide vane 32 heats up faster than the casing 30 due to the annulus air. The nozzle guide vane 32 expands axially forward relative to the casing 30 as it is axially restrained to the casing 30 at its rear. The outer flange 36 rides up the inclined slot 31 in the casing and moves the seal segment 24 radially outward. Movement of the seal segment 24 radially outward increases the seal clearance. As the clearance between the tip of the blade 20 and the seal segment 24 is increased the chances of a radial incursion occurring between the radially expanding blades 20 and the seal segments 24 during engine transients is reduced.

During stabilised engine running conditions the relative axial movement between the nozzle guide vane 32 and the casing 30 is reduced. The outer flange 36 contracts down the inclined slot 31 and moves the seal segments 24 radially inwards. Movement of the seal segments 24 radially inwards reduces the tip clearance and prevents excessive gas leakage from the annulus 28 to improve efficiency. The improved efficiency is also due to the reduction in radial incursions which occur at the transient conditions described.

In a further embodiment of the present invention a fluid manifold 40 is situated adjacent the casing 30. The fluid manifold 40 provides cooling air to the outer wall of the casing 30, over an appropriate region, to optimise relative movement between the outer flange 36 and the inclined slot 31 in the casing 30. Cooling by the fluid manifold 40 imparts either a direct radial contraction or a further relative axial movement between the nozzle guide vane 32 and the casing 30, effecting radial movement of the seal segment 24.

Although in the embodiment described the manifold 40 provides a flow of cooling air it will be appreciated that the manifold 40 could provide either heating or cooling air or a combination thereof which could be selectively operated to control the seal clearance over the entire engine operating range. In this way the seal clearance is increased at transient conditions to prevent radial incursions between the rotor blades 20 and the seal segments 24 and decreases at stabilised conditions to improve efficiency.

It will be further appreciated that although the present invention has been described with reference to an inclined slot 31 or face in the casing 30 that the same effect can be achieved by the provision of an inclined slot or face between the radially inner flange 34 of the nozzle guide vane 32 and the seal segment 24. The radially inclined slot 31 or face is also of benefit if it is located at the front of the seal segment 24.

We claim:

1. A fluid seal comprising a plurality of seal segments, each end of the seal segments being located by support structure, the support structure at least one end of the seal segment being provided with means for translating axial movement of the support structure into radial movement of the seal segment.

2. A fluid seal as claimed in claim 1 in which the means for translating axial movement of the support structure into radial movement of the seal segment is one of an aperture and a face which extends axially and is inclined radially.

3. A fluid seal as claimed in claim 2 in which the one of the inclined aperture and face is provided in the support structure.

4. A fluid seal as claimed in claim 2 in which the one of the inclined aperture and face is provided in the seal segment.

5. A fluid seal as claimed in claim 1 in which the seal segments define a flow annulus enclosing a rotating component.

6. A fluid seal as claimed in claim 5 in which the rotating component is a rotor in a gas turbine engine.

7. A fluid seal as claimed in claim 1 in which the support structure is a vane located by one of an inclined aperture and face in a casing of the engine.

8. A fluid seal as claimed in claim 7 in which the vane has a flange which locates in the inclined aperture or against an inclined face, axial movement of the flange along the inclined aperture or face being translated into radial movement of the seal segment attached thereto.

9. A fluid seal as claimed in claim 8 in which seal segment is attached to the vane via a further flange.

10. A fluid seal as claimed in claim 1 in which a manifold is provided to selectively heat or cool the support structure to control the amount of axial and radial movement.

* * * * *